US007618204B2

(12) United States Patent
Blanchard, Jr. et al.

(10) Patent No.: US 7,618,204 B2
(45) Date of Patent: Nov. 17, 2009

(54) DECURLING TAG WEBS IN PRINTERS/STACKERS

(75) Inventors: Raymond A. Blanchard, Jr., Dryden, NY (US); Donald J. Ward, Sayre, PA (US)

(73) Assignee: Avery Dennison Retail Information Services LLC, Pasadena, CA (US)

( * ) Notice: Subject to any disclaimer, the term of this patent is extended or adjusted under 35 U.S.C. 154(b) by 619 days.

(21) Appl. No.: 11/409,803

(22) Filed: Apr. 24, 2006

(65) Prior Publication Data

US 2007/0248396 A1 Oct. 25, 2007

(51) Int. Cl.
*B41J 15/16* (2006.01)
*B41J 15/04* (2006.01)
*B65H 23/34* (2006.01)

(52) U.S. Cl. ..... 400/618; 400/619; 400/621

(58) Field of Classification Search ..... 399/406; 162/270, 271

See application file for complete search history.

(56) References Cited

U.S. PATENT DOCUMENTS 3,072,051 A 1/1963 Lincoln et al.
3,649,447 A 3/1972 Turner
4,357,560 A 11/1982 Woo et al.
4,532,597 A * 7/1985 Safiuddin et al. ..... 700/126
4,952,281 A * 8/1990 Akira ..... 162/270
5,202,737 A * 4/1993 Hollar ..... 399/406
5,717,836 A 2/1998 Horie
5,884,860 A 3/1999 Ishikawa et al.
7,422,385 B2 9/2008 Koeda et al.
2003/0145967 A1 8/2003 Gafner et al.
2005/0098674 A1 5/2005 Matsugi
2005/0180796 A1* 8/2005 Blanchard et al. ..... 400/613
2007/0059083 A1* 3/2007 Silverbrook et al. ..... 400/614

FOREIGN PATENT DOCUMENTS

JP 63315269 A * 12/1988
JP 07002403 A * 1/1995
JP 2004-223715 2/2004

* cited by examiner

*Primary Examiner*—Daniel J Colilla
(74) *Attorney, Agent, or Firm*—Joseph J. Grass

(57) ABSTRACT

There are disclosed embodiments of a decurler system for tag webs used for example in printers and stackers to automatically remove curl from tag webs to promote further tag handling and better tag appearance. The decurler system may determine the current diameter of a stock roll and gradually adjust parameters such as resistance and back bend so as to compensate for increased set in tag webs as the diameter of the stock roll decreases. In an embodiment, the decurler system may include different sets of parameters for different stock roll diameters depending on the material used for the tag webs.

14 Claims, 11 Drawing Sheets

SAMPLE TABLES

10 POINT COATED TAG STOCK

| ROLL DIA. | UNWIND CURRENT | ROLLER POSITION |
|---|---|---|
| 10" | 0.25A | -0.625" |
| 8" | 0.25A | -0.625" |
| 6" | 0.28A | -0.625" |
| 5" | 0.25A | -0.625" |
| 4" | 0.23A | -0.625" |

FIG. 10

10 POINT UNCOATED TAG STOCK

| ROLL DIA. | UNWIND CURRENT | ROLLER POSITION |
|---|---|---|
| 12" | 0.25A | -1.625" |
| 10" | 0.25A | -1.625" |
| 8" | 0.30A | -1.75" |
| 6" | 0.30A | -1.75" |
| 5" | 0.30A | -1.75" |
| 4" | 0.40A | -2.25" |

FIG. 11

DECURLING TAG WEBS IN PRINTERS/STACKERS

CROSS-REFERENCE TO RELATED APPLICATIONS

U.S. patent application Ser. No. 10/779,990 filed Feb. 17, 2004, Publication No. US 2005/0189796A1 is incorporated herein by reference in its entirety.

Another U.S. patent application entitled "UNWIND FOR PRINTER" , wherein the named inventor is and Donald J. Ward, Ser. No. 11/409,804, filed Apr. 24, 2006, has a disclosure the entirety of which is incorporated herein by reference, and that application discloses features of the printer and its unwind not disclosed either in application Ser. No. 10/779,990 or in the present application.

BACKGROUND OF THE INVENTION

1. Field of the Invention

This invention relates to methods and apparatus for decurling tags and webs in devices such as printers with stacker.

2. Description of Related Art

Printable webs can be comprised of various materials such as uncoated tag stock, coated tag stock, fabric, pressure sensitive label stock, and the like. These materials are typically wound into a supply roll. Such web materials differ as to the amount of memory or set they have from having been wound into a supply roll. For example, it has been found that the memory of certain uncoated tag stock is substantial and is greater than the memory of coated tag stock. On the other hand, the memory of a fabric web is very small. In addition, the amount of curl in a web increases as the distance between the outside of the supply roll and the center of the supply roll decrease. Thus, for materials in which the memory is substantial, the web does not decurl sufficiently as the web passes through a utilization device such as a printer to result in flat tags. Flat tags can be easier to stack in a stacker than curled tags, flat tags can be easier to handle and apply to garments than curled tags, and flat tags have a better appearance. Curled tags present an unsightly appearance. As used herein, the expression "tag web" includes "label webs" and "tags" include "labels".

BRIEF SUMMARY OF THE INVENTION

The following represents a simplified summary of some embodiments of the invention in order to provide a basic understanding of various aspects of the invention. This summary is not an extensive overview of the invention nor is it intended to identify key or critical elements of the invention or to delineate the scope of the invention. Its sole purpose is to present some embodiments of the invention in simplified form as a prelude to the more detailed description that is presented thereafter.

Aspects of the invention relate to decurling methods and apparatus to decurling tag webs that require decurling so that resultant tags are essentially flat to assist in further handling such as printing and/or stacking and to provide tags of enhanced appearance. Methods for decurling tag webs may include increasing tension on tag webs as they are fed from a supply roll. Methods for decurling may alternatively or additionally include modifying the path of the tag web so as to increase the back bend of the tag webs as they are fed from a supply roll. Systems for decurling may include a motor-driven unwind that can resist the feed of tag webs. Systems for decurling may alternatively or additionally include a movable guide that can be adjusted so as to increase the back bend of the tag webs as the they are fed from a supply roll.

Other features and benefits will be evident from the following detailed description and reference to the accompanying drawings.

BRIEF DESCRIPTION OF THE DRAWINGS

The present invention is illustrated by way of example and not limited in the accompanying Figures in which like reference numerals indicate similar elements and in which:

FIGS. 10 and 11 are charts showing amperages applied to the unwind motor for webs of different materials.

DETAILED DESCRIPTION OF THE INVENTION

Disclosed are embodiments of methods that comprise providing a tag web wound into a supply roll, the tag web having a curl from having been-wound into a supply roll, the amount of curl in the tag web increasing as the distance between the outside of the supply roll and the center of the supply roll decreases, and performing either one or both of the following steps: increasing the tension in the tag web as the tag web is fed from the supply roll, and modifying the path of the tag web to increase the back bend or reverse bend in the tag web as the tag web is fed from the supply roll. The result is the production of flatter tags. Also disclosed is apparatus for performing the disclosed methods.

The disclosed embodiments can use a motor-driven unwind to supply the tag web under tension and a feed roll to feed the tag web. The motor for the unwind produces a back-electromotive force (back-EMF), which is useable to increase electrical energy to the motor and/or to move a movable guide to increase a reverse bend in the tag web. Thus, the unwind and the movable guide roll cooperate to provide a decurling system usable in conjunction with utilization devices such as printers and/or stackers.

In controlling the decurling, assessment or monitoring of the amount of curl at any place in the web in the supply roll is made preferably continuously during the operation of the utilization device such as the printer. A preferred method and apparatus is to sense or measure the back-EMF of the unwind motor because the back-EMF is representative of the amount of curl in the web at the place where the web is paid out of the supply roll. An alternative is to assess or monitor the speed of rotation of the supply roll by a suitable encoder. This can be accomplished by sensing or monitoring the speed of rotation of the supply roll directly or by a shaft encoder on the unwind or on the unwind motor shaft which is also representative of the amount of curl at the place the web is paid out of the supply roll. Yet another way is to sense the radius of the supply roll by a mechanical or optical sensor.

Before discussing additional details of embodiments of the present invention, reference may be had to application Ser. No. 10/779,990, for certain details of construction. It should noted that the references character used in the present application to designate components are used in a similar manner in the Ser. No. 10/799,990 application.

Figure 1:
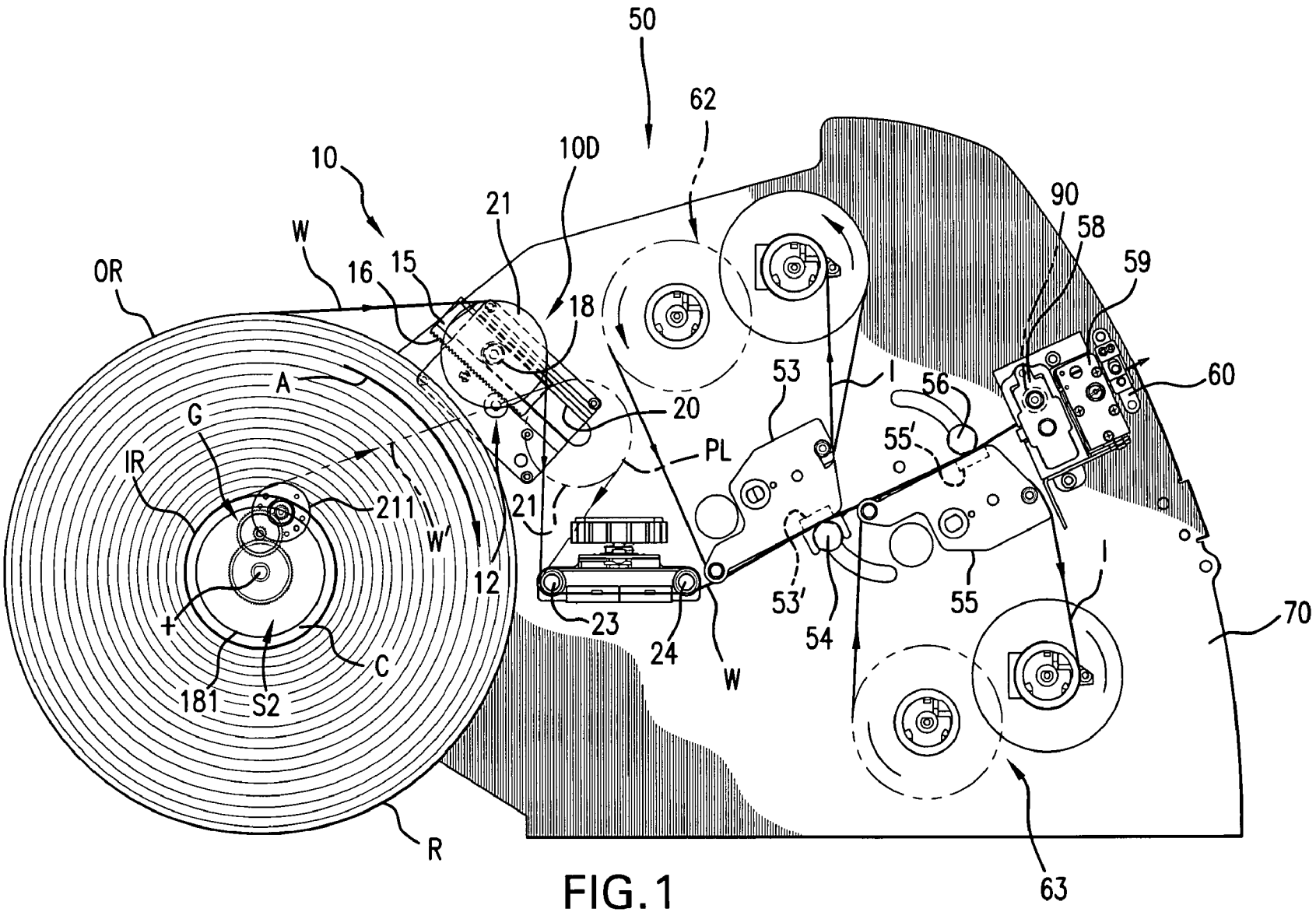
FIG. 1 is an elevational view of a printer for printing on tag webs.
Figure 2:
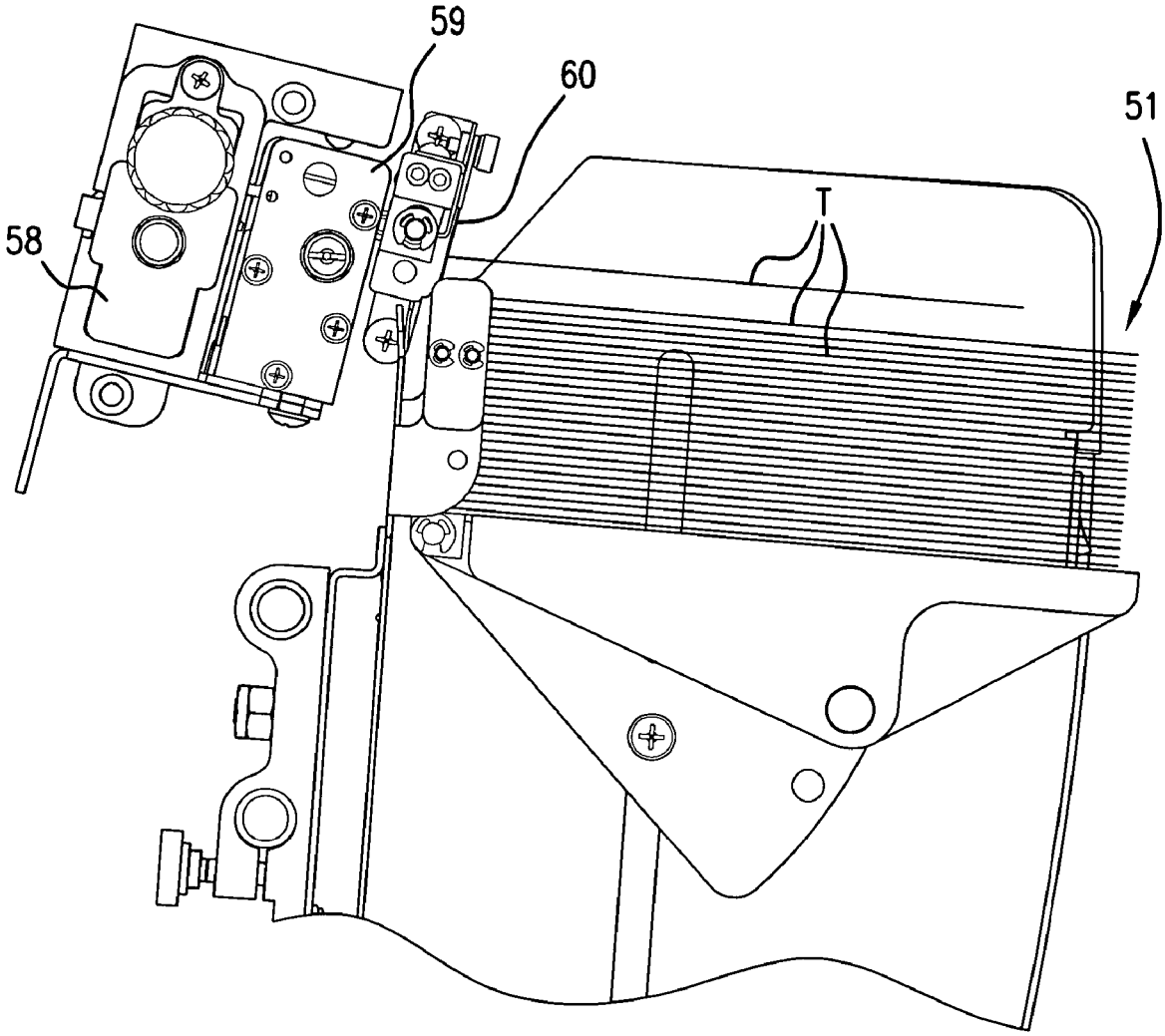
FIG. 2 is an enlarged elevational view of portions of the printer and a stacker for stacking tags.

Referring now to FIG. 1, a printer 50 is used to print on webs W which can be comprised of various materials, such as coated tag webs, uncoated tag webs, fabric label webs and pressure sensitive label webs. The printer 50 includes a stacker 51 which is shown in FIG. 2 for clarity of illustration. As depicted, the printer 50 includes an unwind or unwind mechanism 52 which mounts a web supply roll R. The unwind mechanism 52 includes a D.C. electric motor 211 that rotates a hub 181 through gearing G. A core C of the supply roll R is mounted on the hub 181. The unwind 52 applies a tensioning force to the web W by attempting to rotate the roll counterclockwise, that is, opposite to the direction of arrow A in FIG. 1. However, the force exerted on the web W to feed the web W through the printer 50 overcomes the force exerted by the unwind 52 to enable the web W to be fed through the printer 50.

The printer 50 includes print head assemblies 53 and 55 with respective print heads 53' and 55'. Platen rolls 54 and 56 can cooperate with respective print heads 53' and 55' to print on lower and upper sides of the web W. Unlike in the printer of application Ser. No. 10/779,990, both platen rolls 54 and 56 are idler rolls. It should be noted that the dispositions of the print head assemblies 53 and 55, the platen rolls 54 and 56 and the web path is slightly different in FIG. 1 than in application Ser. No. 10/779,990. A feed mechanism 58 includes a driven feed roll 90 best shown in application Ser. No. 10/779,990. The feed roll 90 feeds the web W to a cutter 59. The cutter 59 cuts the web W into predetermined length sheets such as tags or labels. In the case of tags T, they are fed into the stacker 51 by its stacker feed mechanism 60. The stacker 51 is attached to a frame plate 70 of the frame of the printer 50.

The printer 50 is illustrated to be a thermal transfer printer although the invention is applicable to other types of printers such as electrographic, ink jet, laser printers, stackers and other devices. The printer 50 includes microprocessor controlled ink ribbon systems 62 and 63, each which may be controlled as disclosed in U.S. Pat. No. 5,820,277. The systems 62 and 63 bring ink ribbons I to between the print head 53' and the platen roll 54 and the print head 55' and platen roll 56, respectively.

The web W has been wound into the supply roll R and the amount of curl in the tag web increases as the distance between the outside of the supply roll and center of the supply roll decreases. Due to the memory of the tag web, certain web materials take a substantial set, that is, they retain a substantial amount of their curl after having been fed out or paid out of the supply roll. It can be seen that the amount of curl in the outer wrap OR is substantially less than the curl in the inner wrap IR.

Figure 3:
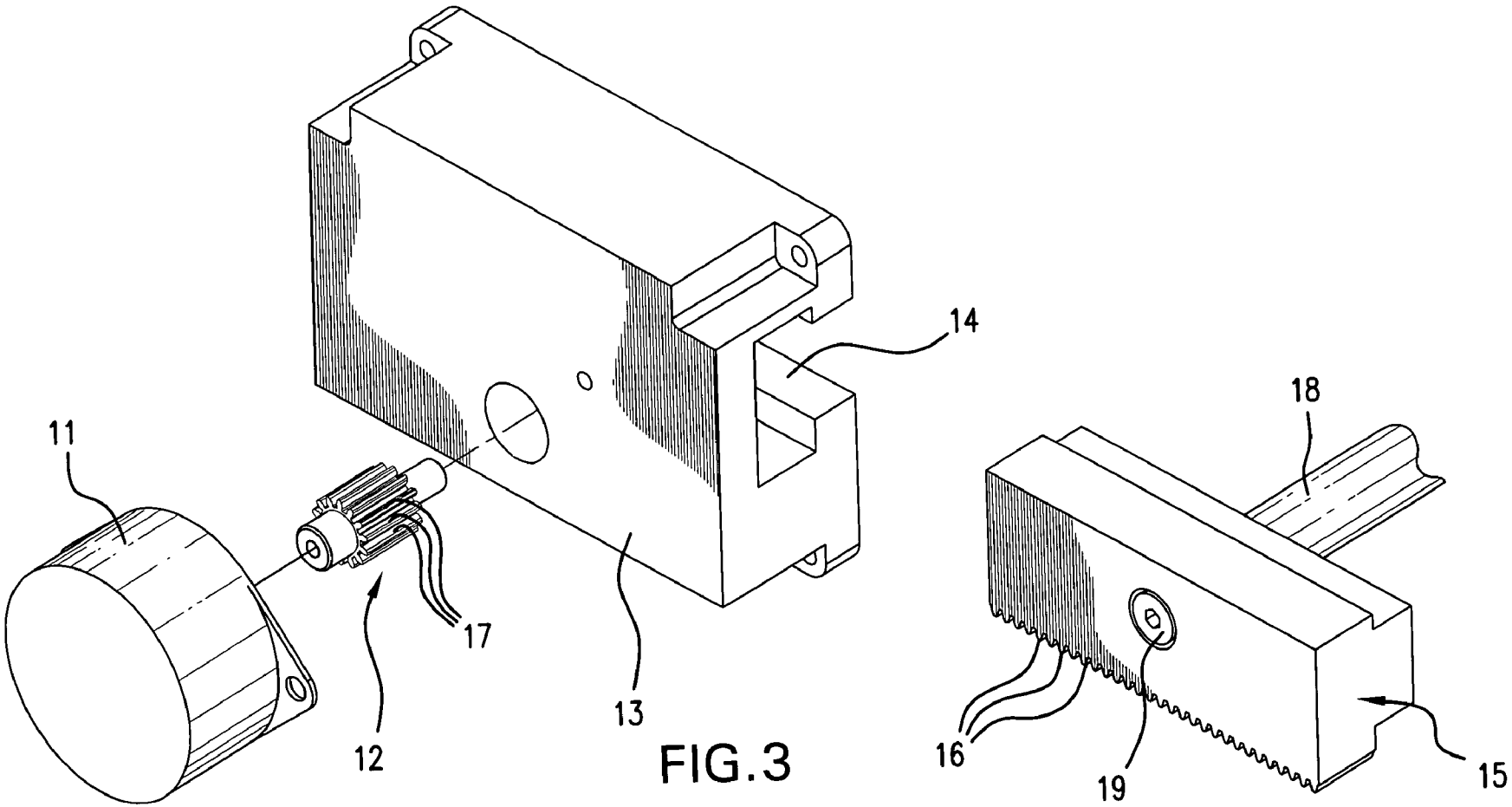
FIG. 3 is an exploded fragmentary perspective view of one embodiment of a decurler for a tag web also shown in FIG. 1.
Figure 4:
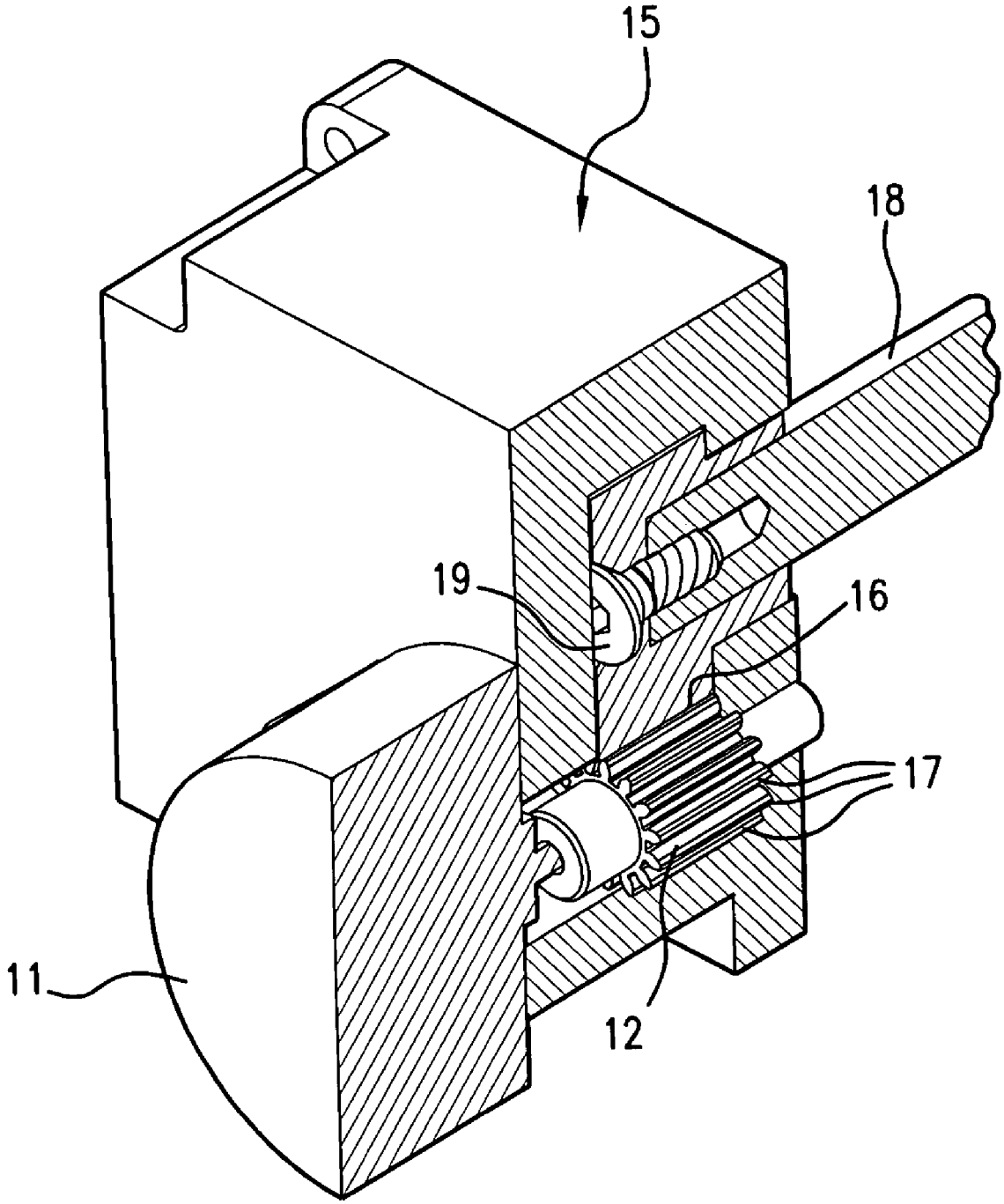
FIG. 4 is an assembled fragmentary perspective view of the portion of the decurler shown in FIG. 3.

With reference to the embodiment of FIGS. 1 through 4, there is provided a decurling system generally indicated at 10. The decurler system 10 is shown in FIG. 3 to include a decurler 10D having an electric motor 11 to drive a gear or pinion 12 rotatably mounted in a block 13. The block 13 is bolted to the frame plate 70. The block 13 has a T-slot 14 which slidably receives a rack or gear 15. The rack 15 has gear teeth 16 that are coupled by meshing with teeth 17 of the pinion 12. The block 15 mounts a shaft 18. The shaft 18 is secured to the rack 15 by a screw 19. The shaft 18 extends through a slot 20 in the frame plate 70 and rotatably mounts a guide in the form of a roll 21. Rotation of the pinion 12 by the motor 11 causes the rack 15 and the roll 21 to translate in a straight line to change the position of the roll 21.

The guide 21 and the web W are shown in solid line positions in FIG. 1, wherein the outer wrap OR of the web W of a substantially full roll R passes partially around or about the movable guide 21. From there, the web W passes through a bend 22 partially around or about a preferably fixed guide 23.

In that the web W is bent in a direction opposite to the curl, the modestly curled web is straightened. From there the web W passes partially around a preferably fixed guide 24. From there the web W passes to print heads 53' and 55' in succession, then to the feed mechanism 58 and to the cutter 59. When a stacker 51 is provided, the stacker feed mechanism 60 feeds the cut tag T into a stack S in the stacker 51. It is the portion of the web path between the movable guide 21 and the fixed guide 23 that is modifiable by moving the guide 21. The guide 21 is also shown in a different position by phantom line PL. In the phantom line portion of the guide 21, the reverse bend 22 in the W has greatly increased. Accordingly, as the curl in the web increases upon depletion of the roll R, the decurling action increases because the guide 21 is moved toward the phantom line position progressively to cause the web to undergo greater and greater bending in a direction opposite to the curl in the web W.

Figure 5:
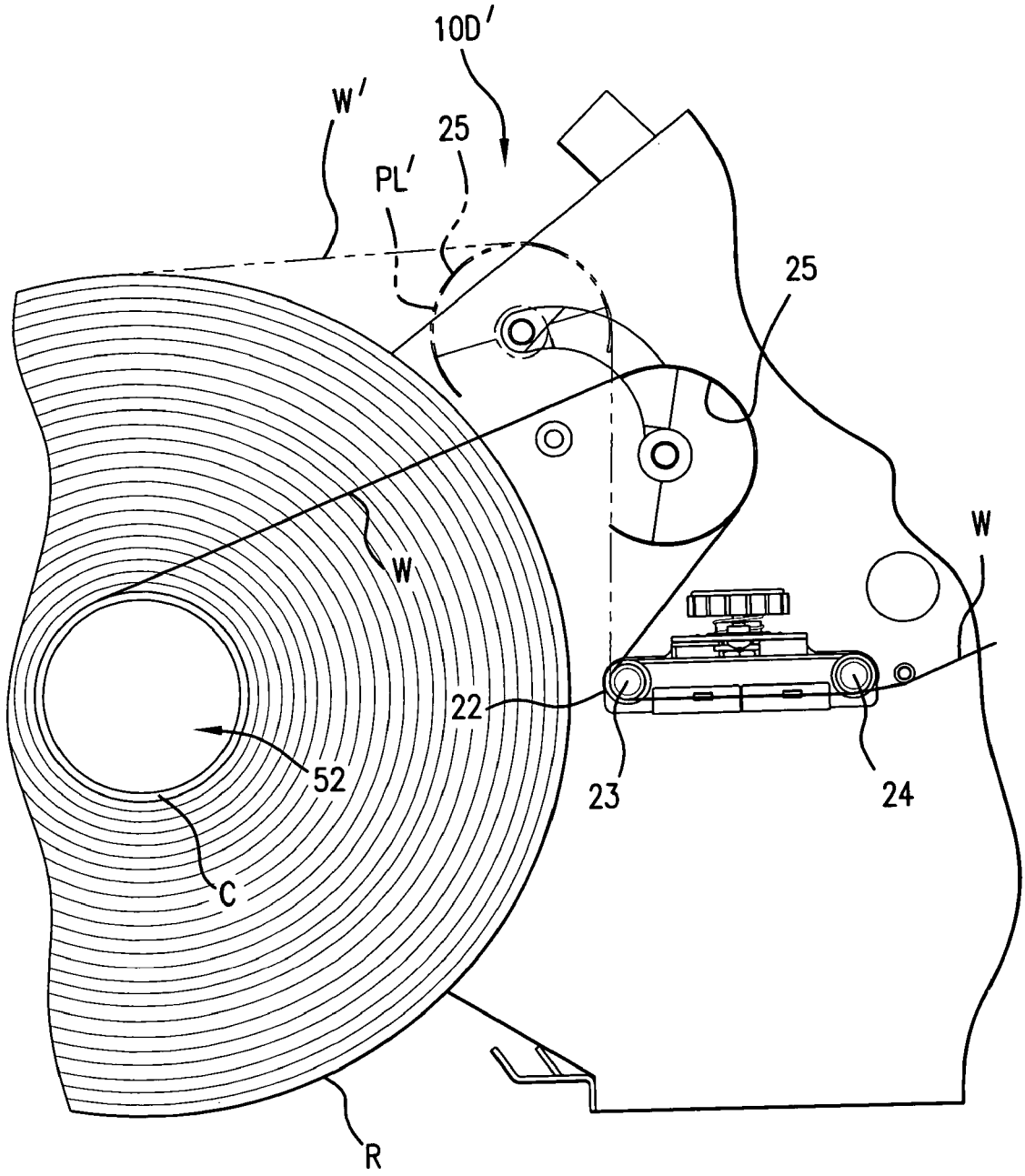
FIG. 5 is an elevational view of a fragmentary portion of the printer with an alternative embodiment of a decurler.
Figure 6:
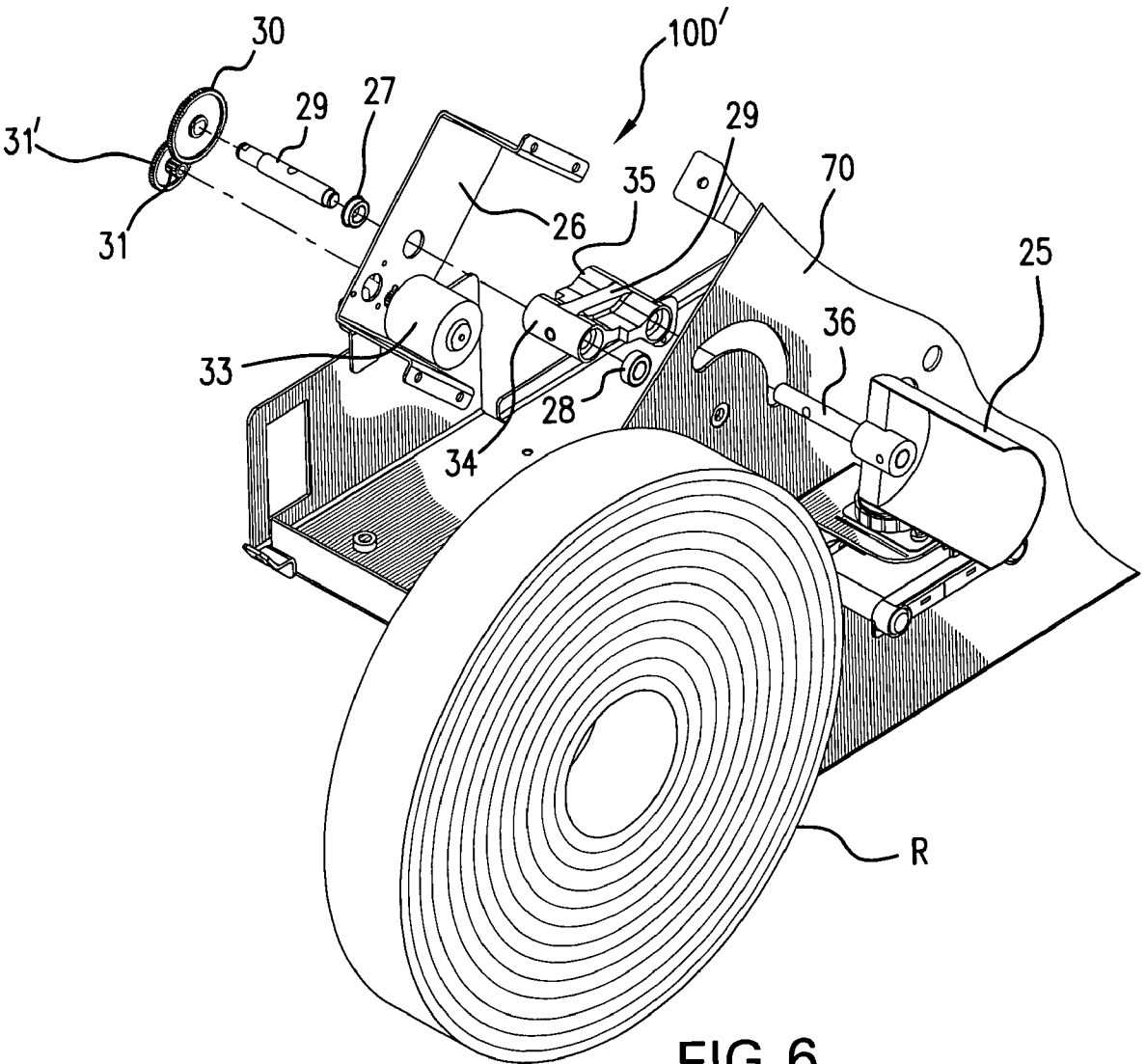
FIG. 6 is an exploded perspective view of the alternative embodiment of a decurler shown in FIG. 5.

In the embodiment of FIGS. 5 and 6, which is the same as the embodiment of FIGS. 1 through 4 except as otherwise shown and described, decurler 10D' of the system 10 includes a guide 25 which takes the form of a curved plate or partial circular cylinder controlled as best shown in FIG. 6. A bracket 26 is secured to the rear face of the frame plate 70. Bearings 27 and 28 mounted in the bracket 26 and the frame plate 70, respectively, rotatably mount a shaft 29. The shaft 29 is secured to an arm 29 and to a compound gear. The gear 30 includes a small gear (not shown in FIG. 6). The small gear of the compound gear 30 meshes with a compound gear 31 which includes a pinion 31' is directly driven by a D.C. motor 33. The guide positioning motor 33 is mounted to the bracket 26. The arm 29 includes a tubular portion 34 through which the shaft 29 extends and a tubular portion 35 which receives and is secured to a shaft 36. The shaft 36 extends through an arcuate slot 37 in the frame plate 70. The guide 25 preferably has a smooth low-friction outer surface that contacts the web W.

When the motor 33 is energized it can cause the movable guide 25 to move between the phantom line position shown by phantom lines PL' and the solid line position shown in FIG. 5. The web paid out of the roll R in the phantom line position is shown at W'. From there the web indicated: at W' passes partially around the guide 25 and from there through a bend 22 partially about the fixed guide 23. As the roll is depleted the motor 33 moves the guide progressively toward the solid line position at which the reverse bend 22 is the greatest. Thus, in the phantom line position, the position for the guide 25 causes the web to undergo the least bending as the web passes about the guide 23, whereas in the solid line position, the position of the guide 25 causes the web to undergo the greatest reverse bending. In all positions of the guide 25, the web is bent in a direction opposite to the curl, as in the embodiment of FIGS. 1 through 4.

Figure 7:
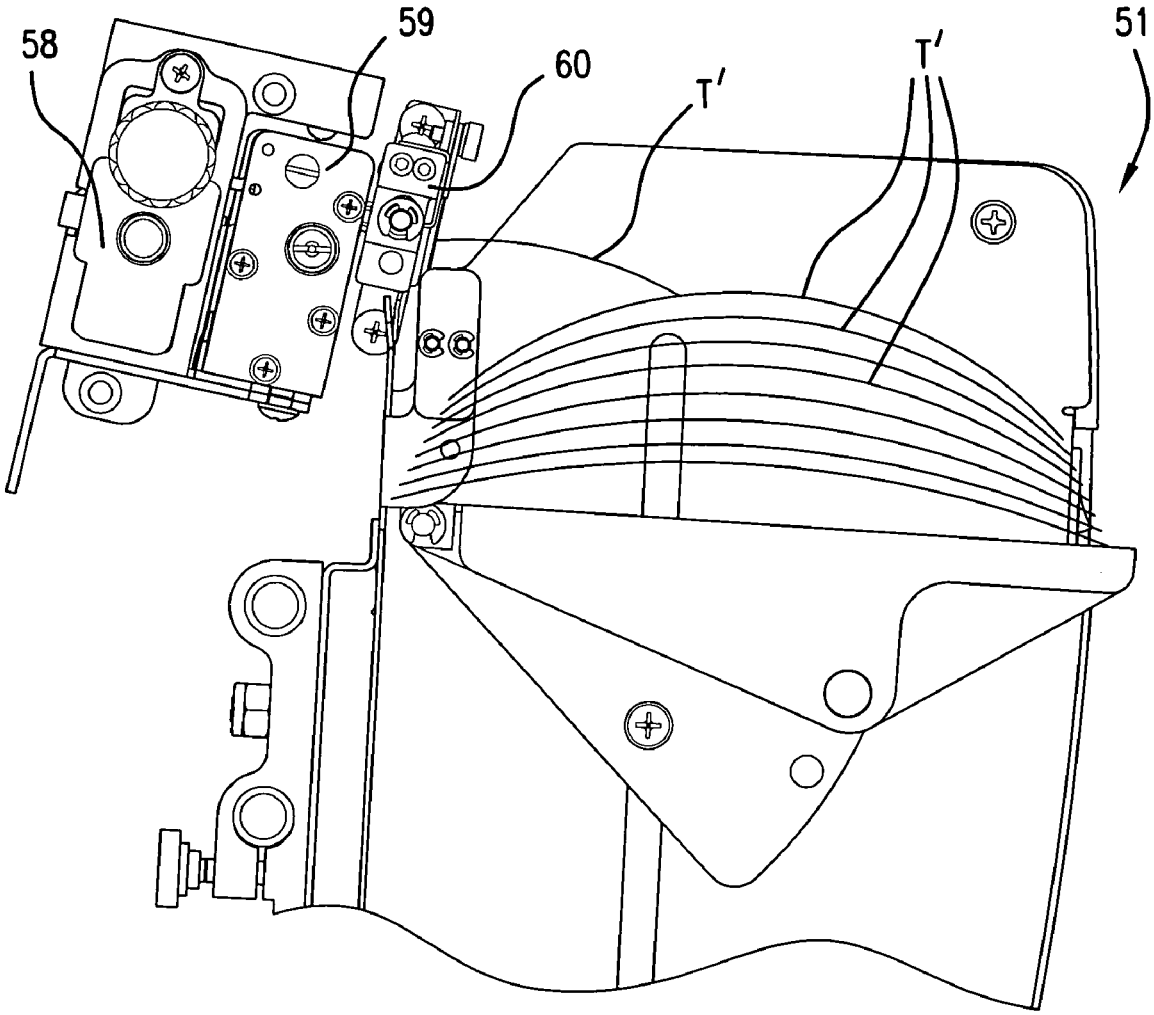
FIG. 7 is an enlarged elevational view of the stacker shown in FIG. 2 with tags that have not been decurled.

FIG. 7 illustrates how poorly certain curled tags T' would stack in the stacker 51, a situation the decurler system 10 avoids.

The use of a small diameter core for the supply roll can be beneficial because more web can be loaded onto a small diameter core. The amount of curl in the web can be problematic with some web materials when the diameter of the core is small. By way of example, not limitation, a small diameter core can have a three inch (7.62 cm) diameter. A more usual size core has a four inch (10.16 cm) diameter. Thus, the web within a radius of one and one-half inches (3.81 cm) and two inches (5.08 cm) has considerably more curl than the web at greater radii. The method and apparatus of the invention are useful with supply rolls of various sizes including those with small diameter cores.

Figure 8:
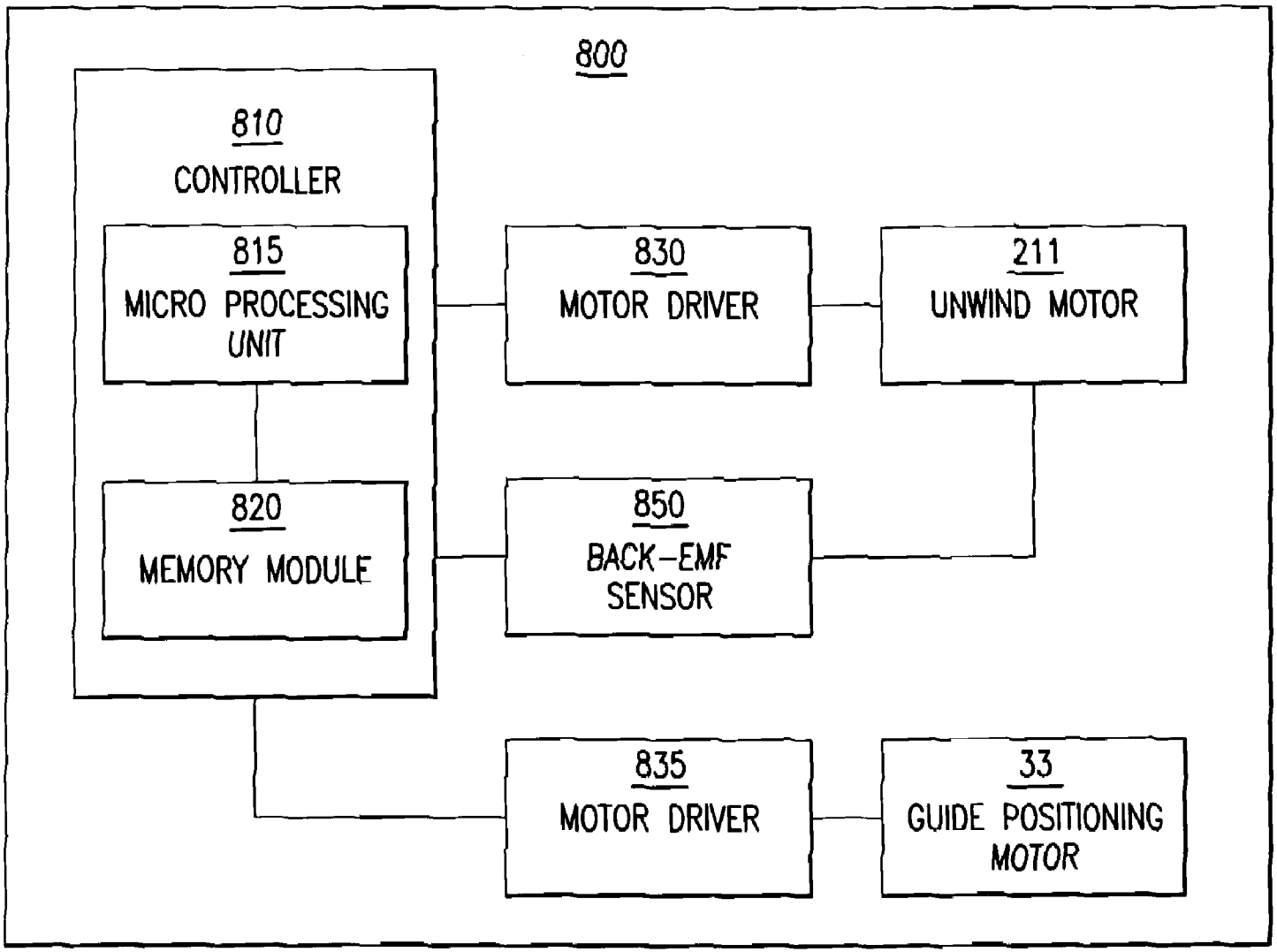
FIG. 8 is a simplified block diagram of the control for the decurler system.

Turning to FIG. 8, a schematic representation of an embodiment of a control system 800 for a decurler system. A controller 810, which includes a micro processing unit (MPU) 815 and a memory module 820, provides control signals to a motor driver 830 that controls an unwind motor 211. A back-EMF sensor 850 is coupled to the unwind motor 211 and configured to detect back-EMF from the unwind motor 211 and provide feedback to the controller 810. The controller 810 also provides control signals to a motor driver 835, which controls a guide positioning motor 33. In an embodiment, the controller 810 interacts with the detected back-EMF signal provided by the back-EMF sensor 850 according to executable instructions stored in the memory module 820.

As can be appreciated, the memory module 820 may be one or more memories and may further comprise one or more types of memory, including but not limited to, flash memory, random-access memory (RAM), read-only memory (ROM), programmable read-only memory (PROM), erasable programmable read-only memory (EPROM), electrically erasable programmable read-only memory (EEPROM). As the use and select of various type of memory is known in the art, no further discussion of the memory module 820 will be provided.

It should be noted that while depicted as two separate components, the motor driver may be a single component configured to control both the unwind motor 211 and the guide positioning motor 33. Furthermore, the motor driver may be incorporated into the controller and may also be included in the motors themselves. However, as can be appreciated, some mechanism for converting the digital signals of the controller to analog control signals for the motor should be provided such as, for example, commercially available analog-to-digital converters.

It should be noted that an embodiment of the controller may comprise an amalgam of hardware and software. As can be appreciated, application specific integrated circuits (ASICs) without separate software may also be used to implement aspects of the present invention.

Figure 9A:
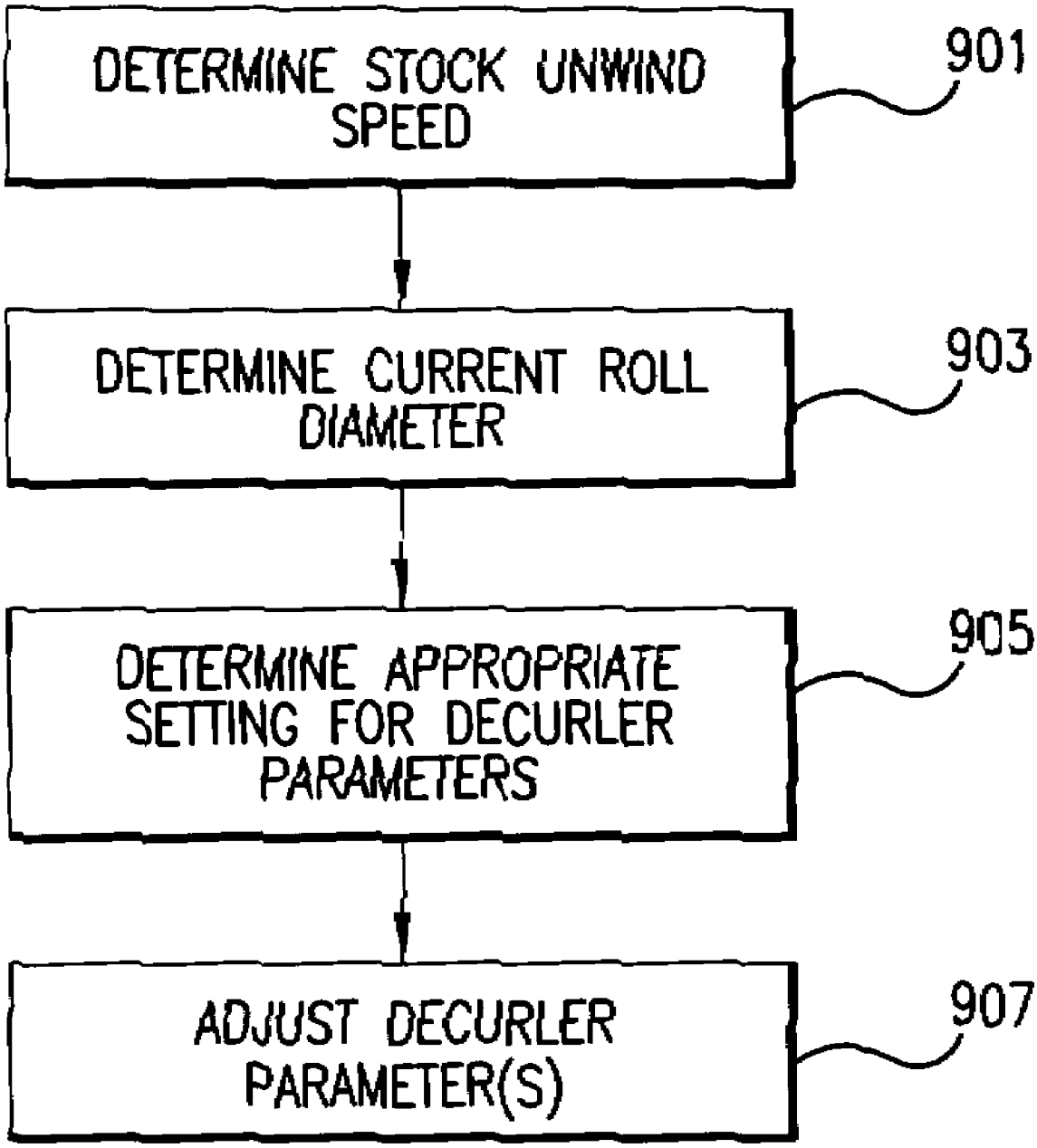
FIG. 9 is a flow chart of the decurler system's software control.

FIG. 9A depicts a high-level process for using the control system 800. First in step 901, the stock unwind speed is determined. In an embodiment, the speed may be determined by a signal provided from the back-EMF sensor, which may measure voltage across the unused winding of a brushless DC motor. Thus, in an embodiment, the rotational velocity of the stock roll may be determined by measuring the resultant back-EMF generated by the unwind motor. As can be appreciated, numerous other methods of determining the rotational velocity of the stock roll are possible. In an embodiment without an unwind motor, for example, an optical sensor (not shown) could be configured to measure the rotational velocity of the stock roll. As the use of sensors to measure rotation velocity is well known in the art, no further discussion will be provided.

Next in step 903, the diameter of the stock roll is determined. In an embodiment, this can be determined by comparing the rotational speed of the stock roll with the print speed. Alternatively, a sensor (not shown) may be used to determine the diameter of the stock roll. Such a sensor may physically measure the size or may provide information, such as the weight of the stock roll, that allows the diameter of the stock roll to be determined through some other calculation.

Next in step 905, a check is made to determine the appropriate settings for parameters of the decurling system in view of the current diameter. As noted above, it can be useful to increase the amount of either tension or bend back or both as the diameter of the stock roll decreases so as to overcome the set of the tag web due to the decreased radius. As can be appreciated, the change in the parameters may be linear with the change in the radius of the bend in the tag web or it may be non-linear, depending on the material and the lower diameter limit of the stock roll. As can be appreciated, some materials may require more than a proportional increase in decurling efforts while other materials may respond equally well to a decurling effort that is capped at some upper limit of decurling effort.

Then in step 907, the parameters of the decurling system are adjusted to account for the current stock roll diameter. In an embodiment, an increased current may be supplied to the unwind motor 211 (FIG. 8) so as to increase the resistance to the feeding of the tag web stock. In an alternative embodiment, the position of the movable guide 21 (FIG. 1) may be adjusted so as to provide additional back bend to the tag stock as it travels along the feed path. In another alternative embodiment, both the resistance provided by the unwind motor 211 and the bend back provided by the movable guide 21 may be adjusted.

Figure 9B:
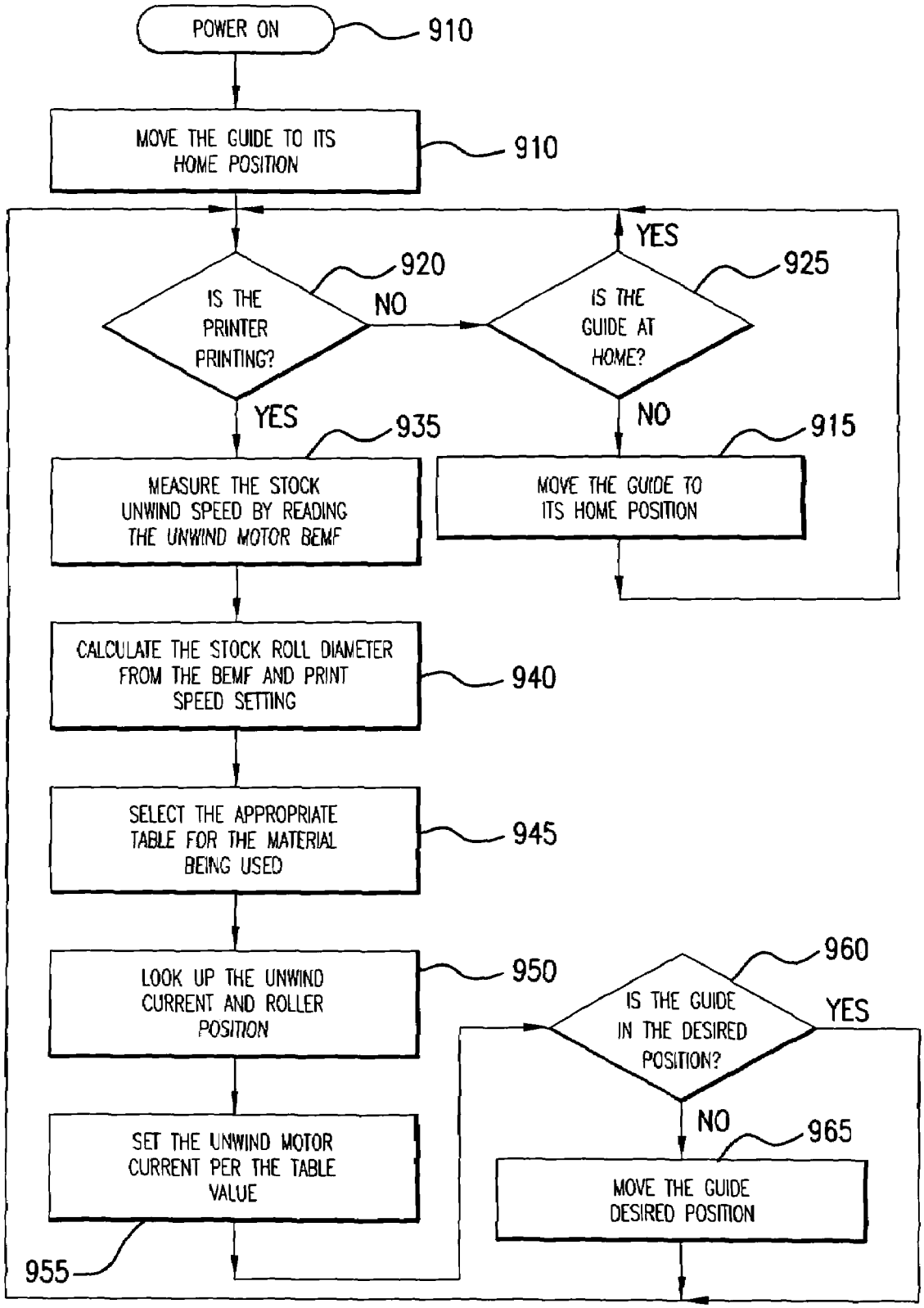

FIG. 9B provides a more detailed embodiment of the method generally disclosed in FIG. 9A. As can be appreciated, the method in disclosed in FIG. 9B includes steps that are typically performed by a printer. However, this embodiment is merely representative and steps may be omitted or additional steps may be added as is appropriate.

In step 910, power is turned on. Next in step 915 the guide is moved to its home position. It should be noted that the roller referred to in step 915 may also be referred to as the guide 21 or the guide 25. In step 920 a check is made to see if the printer is printing. If it is not, in step 925 a check is made to see if the guide is the home position. If the guide is not in the home position, in step 930 the guide is moved to the home position. Steps 920 and 925 are repeated until the printer begins to print. As can be appreciated, this check may take place at some predetermined frequency that is determined to be sufficiently often so as to avoid undesirable delays between the initiation of printing and the adjustment of the decurling parameters.

Once it is determined that the printer is printing, in step 935 the unwind speed of the stock roller is determined by reading the unwind motor back-EMF. The speed may be determined in rpm's or some other unit of measurement such as radium per second (which is a simply rpm's multiplied by ($\pi/30$)). Next in step 940, the stock roll diameter is determined by comparing the unwind speed of the stock roll with the print speed. As is known, the arc length $s=\theta r$ where $\theta$ is in radians. As the print speed may be determine in units of distance per second, the radius may be approximated as $r=v/\omega$. Therefore, as v (the printer speed) is known and $\omega$, the angular speed is known because of the determination in step 935, r can be determined. Of course this will only provide an approximate answer because r is not constant; however such a method should be sufficiently accurate for the diameter determination of step 940.

Next in step 945, the appropriate table is selected depending on the material that is being used. Examples of tables are provided in FIGS. 10 and 11. As can be appreciated from tables 10 and 11, both a guide displacement value and a current value may be provided. It should be noted that these values can vary depending on the size of the guide and the efficiency of the unwind motor and the type of material. Consequently, the provided values are for illustrative purposes. It should be noted that in an embodiment, the type of material can be entered or selected by a user. In an alternative embodiment, the stock roll may include an indicium or some type of indicator that can be read by the printer so that the type of material is known. For example, a radio frequency identification (RFID) transponder in the stock roll could be used to provide the type of material.

It should also be noted that while both a current value and a guide position are provided, in an embodiment where only one or the other is adjustable it is expected that the parameter that is not adjustable will not be provided. For example, if the position of the movable guide automatically adjusts as the diameter of the stock roll decreases (perhaps due to an interaction with a guide that maintains contact with the surface of the stock roll), then only the current of the unwind motor may be adjusted. Alternatively, if the current of the unwind motor is left fixed so as to simplify the controls, then only the position of the guide motor may be adjusted. While either of these approaches may be less flexible, for situations where there is less of a variation in the type of tag web they may provide desirable results at a reduced cost.

Next, in step 950, the current radius is used to determine the desired current and (guide position. It should be noted that additional values may be provided for more fine-grained control. Alternatively, the radius of the stock roll may be rounded off to the depicted level of precision.

In step 955, the current is adjusted per the value provided in the table. Next in step 960, a check is made to determine whether the guide is in the correct position. As can be appreciated, a stepper motor may be used so as allow the controller 810 (FIG. 8) to track the position of the movable guide (by counting the number of steps). In an alternative embodiment, Hall-effect sensors could be used to track the rotations of the motor and thus be used to determine the current position of the guide based on a known initial position. Alternatively, the translation of the movable guide may be resisted by a biasing element that stores potential energy (such as a spring). Assuming a linear relationship, the equation $F=kx$ may be used, where F is the force, k is the spring constant (which will be known) and x is the displacement in length. By measuring the force, the displacement x can be ascertained (and thus the position of the roller determined). As can be appreciated, however, numerous other known methods of determining the location of the movable guide and the associated roller may be used.

If the guide is in the correct position, the check in step 920 is repeated. However, if the guide is not in the correct position, in step 965 the guide is moved to the correct position and then the check in step 920 is repeated.

As can be appreciated, additional methods of initiating the steps 935 through 960 are possible. In an embodiment, the controller 810 (FIG. 8) may keep track of whether the printer is printing and rather then a looped check as depicted, box 920 may simply wait for a signal that the indicates the printer is printing without checking. Furthermore, if a variable current is not supplied to an unwind motor then steps 950 and 955 may be omitted. Other variations in the method depicted will occur to a person of ordinary skill in the art.

The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A system for use in handling a tag web, comprising:

an unwind including an unwind motor and a holder driven by the unwind motor and adapted to hold a supply roll of tag web, the tag web having a curl from having been wound into the supply roll, the amount of curl in the tag web increasing as the distance from the outside of the supply roll and the center of the supply roll decreases;

a motor-driven feed roll to apply force to feed the tag web from the outside of the supply roll under tension along a path through a bend opposite to the curl in the tag web;

wherein the unwind motor is operable to apply a tensioning force to the tag web opposite to the force exerted by the feed roll, wherein the tag web is fed along the path when the force exerted by the feed roll on the tag web overcomes the force exerted by the unwind on the tag web;

a movable guide disposed along the path to contact and guide the tag web;

a guide motor to move the movable guide;

a decurler guide disposed along the path to contact the tag web, downstream of the movable guide;

a sensor to sense the back-EMF of the unwind motor; and a controller to control the guide motor to move the movable guide, wherein the controller, in operation, can cause the movable guide to move to increase a bend in the path of the tag web partially around the decurler guide as the tag web is fed from the supply roll, and wherein the controller is configured to be responsive to the sensor and to increase the electrical energy to the unwind motor as the back-EMF of the unwind motor increases.

2. A system as defined in claim 1, including a print head to print on the tag web;

a cutter to cut printed tags from the tag web; and a stacker to stack the cut tags into a stack.

3. A system as defined in claim 1, wherein the movable guide includes a guide roll adjacent to the supply roll.

4. A system as defined in claim 1, wherein the movable guide comprises a curved plate.

5. A system as defined in claim 1, including a print head disposed along the path between the decurler guide and the feed roll.

6. A system for use in handling a tag web, comprising:

an unwind including an unwind motor and a holder driven by the unwind motor and adapted to hold a supply roll of tag web, the tag web having a curl from having been wound into the supply roll, the amount of curl in the tag web increasing as the distance from the outside of the supply roll and the center of the supply roll decreases;

a motor-driven feed roll to apply force to feed the tag web from the outside of the supply roll under tension along a path through a bend opposite to the curl in the tag web;

wherein the unwind motor is operable to apply a tensioning force to the tag web opposite to the force exerted by the feed roll, wherein the tag web is fed along the path when the force exerted by the feed roll on the tag web overcomes the force exerted by the unwind on the tag web;

a movable guide disposed along the path to contact and guide the tag web;

a guide motor to move the movable guide;

a decurler guide disposed along the path to contact the tag web, downstream of the movable guide;

a sensor to sense the back-EMF of the unwind motor; and a controller responsive to the back-EMF sensed by the sensor to control the guide motor to move the movable guide, wherein the controller, in operation, can cause the movable guide to move to increase a bend in the path of the tag web partially around the decurler guide as the tag web is fed from the supply roll.

7. A system as defined in claim 6, including a print head to print on the tag web.

8. A system for use in handling a tag web, comprising:

a print head capable of printing in the tag web;

an unwind including an unwind motor and a holder driven by the unwind motor and adapted to hold a supply roll of tag web, the tag web having a curl from having been wound into the supply roll, the amount of curl in the tag web increasing as the distance from the outside of the supply roll and the center of the supply roll decreases;

a motor-driven feed roll to apply force to feed the tag web from the outside of the supply roll under tension along a path through a bend opposite to the curl in the tag web;

wherein the unwind motor is operable to apply a tensioning force to the tag web opposite to the force exerted by the feed roll, wherein the tag web is fed along the path when the force exerted by the feed roll on the tag web overcomes the force exerted by the unwind on the tag web;

a movable guide disposed along the path to contact the tag web directly after the tag web passes from the supply roll;

a guide motor to move the movable guide;

a decurler guide disposed along the path to contact the tag web directly after the tag web passes from the movable guide;

a sensor to sense the back-EMF of the unwind motor; and a controller responsive to the sensor to control the guide motor to move the movable guide, wherein the controller, in operation, can cause the movable guide to move to increase a bend in the path of the tag web partially around the decurler guide as the tag web is fed from the supply roll.

9. A system as defined in claim 8, including a cutter to cut printed tags from the tag web; and a stacker to stack the cut tags into a stack.

10. A system as defined in claim 8, wherein the controller is configured to be responsive to the sensor and to increase the electrical energy to the unwind motor as the back-EMF of the unwind motor increases.

11. A system as defined in claim 8, the controller being capable of operating the unwind motor to increase the tension in the tag web based on the sensed back-EMF.

12. A system for use in handling a tag web, comprising:

an unwind including an unwind motor and a holder driven by the unwind motor and adapted to hold a supply roll of tag web, the tag web having a curl from having been wound into the supply roll, the amount of curl in the tag web increasing as the distance from the outside of the supply roll and the center of the supply roll decreases;

a motor-driven feed roll to apply force to feed the tag web from the outside of the supply roll under tension along a path through a bend opposite to the curl in the tag web;

wherein the unwind motor is operable to apply a tensioning force to the tag web opposite to the force exerted by the feed roll, wherein the tag web is fed along the path when the force exerted by the feed roll on the tag web overcomes the force exerted by the unwind on the tag web;

a movable guide disposed along the path to contact and guide the tag web;

a guide motor to move the movable guide;

a decurler guide disposed along the path to contact the tag web downstream of the movable guide;

a sensor to sense the back-EMF of the unwind motor; and a controller to control the guide motor to move the movable guide, wherein the controller is responsive to the sensed back-EMF, wherein the controller, in operation, can cause the movable guide to move to increase a bend in the path of the tag web partially around the decurler guide as the tag web is fed from the supply roll, and the controller being capable of operating the unwind motor to increase the tension in the tag web based on the sensed back-EMF.

13. A system for use in handling a tag web, comprising:

an unwind including an unwind motor and a holder driven by the unwind motor and adapted to hold a supply roll of tag web, the tag web having a curl from having been wound into the supply roll, the amount of curl in the tag web increasing as the distance from the outside of the supply roll and the center of the supply roll decreases;

a motor-driven feed roll to apply force to feed the tag web from the outside of the supply roll under tension along a path through a bend opposite to the curl in the tag web;

wherein the unwind motor is operable to apply a tensioning force to the tag web opposite to the force exerted by the feed roll; wherein the tag web is fed along the path when the force exerted by the feed roll on the tag web overcomes the force exerted by the unwind on the tag web;

a movable guide disposed along the path to contact the tag web directly after the tag web passes from the supply roll;

a guide motor to move the movable guide;

a decurler guide disposed along the path to contact the tag web directly after the tag web passes from the movable guide;

a sensor to sense the back-EMF of the unwind motor; and a controller to control the guide motor to move the movable guide, wherein the controller, in operation, can cause the movable guide to move to increase a bend in the path of the tag web partially around the decurler guide as the tag web is fed from the supply roll, and wherein the controller is configured to be responsive to the sensor and to increase the electrical energy to the unwind motor as the back-EMF of the unwind motor increases.

14. A system for use in handling a tag web, comprising:

an unwind including an unwind motor and a holder driven by the unwind motor and adapted to hold a supply roll of tag web, the tag web having a curl from having been wound into the supply roll, the amount of curl in the tag web increasing as the distance from the outside of the supply roll and the center of the supply roll decreases;

a motor-driven feed roll to apply force to feed the tag web from the outside of the supply roll under tension along a path through a bend opposite to the curl in the tag web;

wherein the unwind motor is operable to apply a tensioning force to the tag web opposite to the force exerted by the feed roll, wherein the tag web is fed along the path when the force exerted by the feed roll on the tag web overcomes the force exerted by the unwind on the tag web;

a movable guide disposed along the path to contact and guide the tag web;

a guide motor to move the movable guide;

a decurler guide disposed along the path to contact the tag web downstream of the movable guide;

a sensor to sense the back-EMF of the unwind motor; and a controller to control the guide motor to move the movable guide, wherein the controller, in operation, can cause the movable guide to move to increase a bend in the path of the tag web partially around the decurler guide as the tag web is fed from the supply roil and can cause the unwind motor to increase the tension in the tag web, and wherein the controller is configured to be responsive to the sensor and to increase the electrical energy to the unwind motor as the back-EMF of the unwind motor increases.

* * * * *